United States Patent [19]

Rogers, Jr.

[11] 4,319,780

[45] Mar. 16, 1982

[54] ROCKER-RECLINER CHAIR

[76] Inventor: Walter C. Rogers, Jr., P.O. Box 685, Denton, N.C. 27239

[21] Appl. No.: 85,429

[22] Filed: Oct. 16, 1979

[51] Int. Cl.[3] ..... A47C 1/02

[52] U.S. Cl. ..... 297/85; 297/270

[58] Field of Search ..... 297/DIG. 7, 85, 270, 297/269, 69, 271, 84

[56] References Cited

U.S. PATENT DOCUMENTS

| | | | |
|---|---|---|---|
| 3,537,747 | 11/1970 | Rogers, Jr. | 297/85 |
| 3,550,952 | 12/1970 | Ferguson | 297/85 |
| 3,637,255 | 1/1972 | Ke | 297/270 |
| 3,730,585 | 5/1973 | Rogers et al. | 297/270 |
| 3,767,257 | 10/1973 | Rogers et al. | 297/270 |
| 3,813,150 | 5/1974 | Katz et al. | 297/85 |
| 3,869,170 | 3/1975 | James et al. | 297/270 |
| 4,071,276 | 1/1978 | Cecil | 297/DIG. 7 |
| 4,108,491 | 8/1978 | Rogers, Jr. | 297/85 |

*Primary Examiner*—Francis K. Zugel
*Attorney, Agent, or Firm*—William E. Mouzavires

[57] ABSTRACT

A three-way, handle-operated, rocker-recliner chair includes a base, a rocker frame mounted on the base, a carrier link pivotally mounted on the rocker frame, a seat and armrest unit pivotally mounted on the carrier link through a linkage which includes a backrest link fixed to the backrest, a footrest linkage mounted to the seat and armrest unit and actuated by a manual control handle. When moving from upright to TV position where the footrest is extended, a sequencing linkage prevents relative movement between the seat and backrest and the carrier link during an initial phase of such movement but later permits the seat and backrest to be moved into various advanced reclining positions when the occupant exerts pressure on the backrest which fulcrums about the carrier link. Because of chair styling and leverage requirements, the seat has a seat link with an upwardly projecting V-shaped rear portion which is pivotally connected to the backrest link. A support link is pivotally interconnected between the carrier link and the seat link at the V-shaped portion to help resist stress imparted to the V-shaped portion when the occupant moves into advance reclining positions. A positive lock mechanism is provided to prevent rocking movement of the rocking frame when the seat moves into the TV position.

8 Claims, 5 Drawing Figures

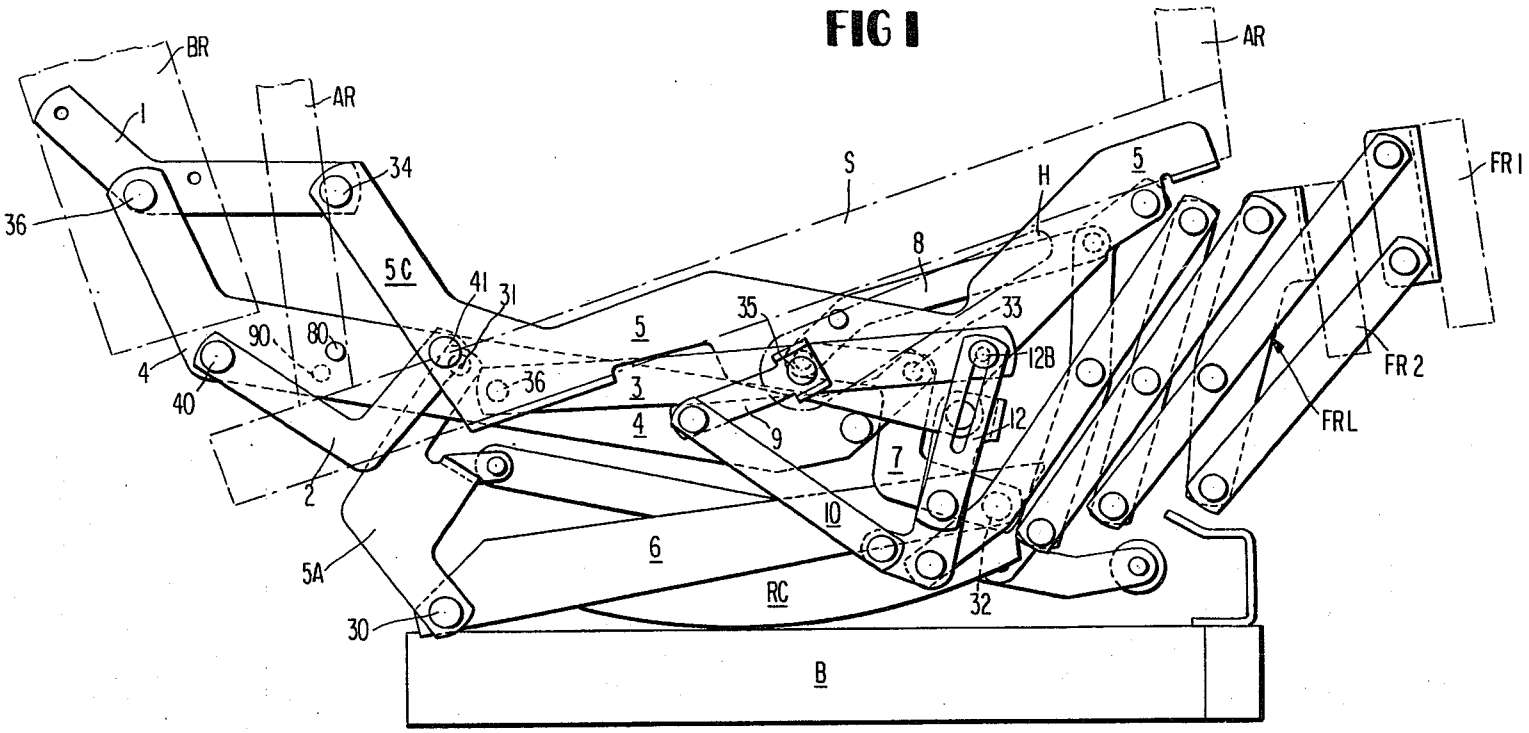
FIG I
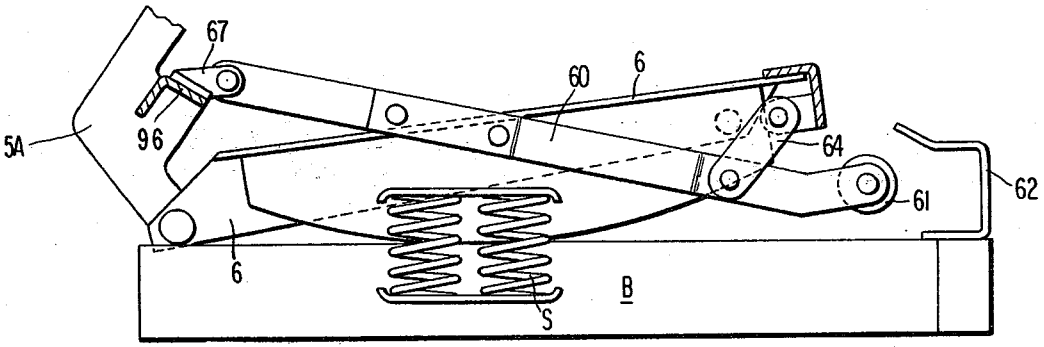
FIG IA

ROCKER-RECLINER CHAIR

OBJECTS OF THE PRESENT INVENTION

The present invention relates to improvements in rocker-recliner chairs and more specifically to an improved three-way, handle-operated, rocker-recliner chair. More specifically, the chair of the present invention is of the type wherein the armrests and seat are combined as a single unit so as to be movable together at all times.

It is a primary object of the present invention to provide such a rocker-recliner chair of the type described above which may be manufactured according to present day, low contour styling requirements and yet has effective leverage for moving the chair into advanced reclining positions by the occupant merely leaning back against the backrest after the chair has been moved to TV position, that being the position in which the footrest is extended. Included herein is the provision of such a chair which will achieve the foregoing object without jeopardizing the strength or shortening the life, of certain of the linkage parts that are subjected to stress when the chair is moved into advanced reclining positions.

Another object of the present invention is to incorporate into a rocker-recliner chair of the type described, a certain amount of wall-avoiding movement when the chair is moved into TV position.

Another object of the present invention is to incorporate in an improved manner into such a rocker-recliner chair of the type described above, a positive lock mechanism which automatically becomes engaged when the chair is moved into TV position to prevent rocking movement.

SUMMARY OF INVENTION

In summary, the present invention in its preferred form includes a fixed base, a rocking frame mounted on the base for rocking movement, a carrier link extending in the generally forward-rearward direction of the chair and being pivotally mounted to the rocking frame by means of front and rear carrier mounting links. A seat and armrest assembly are provided as a unit, and a seat link fixed along the seat, is pivotally mounted on the rocking frame by a first link pivotally interconnecting the seat link and the rocking frame; and a second link (termed a "backrest" link) which is fixed to the backrest and pivotally connected to the seat and carrier links.

A footrest linkage is mounted to the seat to be movable between a retracted position in which a pair of dual footrests extend vertically, one behind the other below the seat, and an extended position projected from the front of the chair where the dual footrests extend one behind the other in generally coplanar relationship. Extension and retraction of the footrest is achieved through a manual control handle mounted to one side of the chair and connected to the footrest linkage to drive the same. The footrest linkage is connected by a transmission link to one of the carrier mounting links so that when the footrest linkage is moved to extended positions, it will swing the carrier link forwardly of the chair. However, during an initial phase of this movement, a sequencing mechanism which is provided, prevents relative movement between the seat, backrest and the carrier link. Subsequently, the sequencing mechanism will free the seat and backrest to enable them to be moved into advance reclining positions by the occupant leaning against the backrest causing the backrest to fulcrum about the carrier link in the rearward direction of the chair.

Because of the chair styling requirements and the high degree of leverage which is desired in order to comfortably place the chair into advanced reclining positions, the rear end portion of the seat link is formed with a generally V-shape, that is with the rear end portion projecting upwardly and rearwardly at an abrupt angle relative to the main portion of the seat link. In order to lessen the stress imparted to this rear end portion of the seat link, an additional support link is pivotally interconnected between the seat link at the area of the V-shaped portion thereof and the carrier link to absorb or counter stress imparted to the rear portion of the seat link on the one hand by the backrest link which is under the pressure of the occupant's back and on the other hand, by the occupant's weight acting on the seat link in the opposite direction.

In order to prevent rocking movement of the chair when it is placed into the TV position, a positive lock mechanism is incorporated in a novel manner. The lock mechanism includes a keeper fixed to the front of the base to receive the front end of an elongated locking member whose rear end is pivotally connected to the rear carrier mounting link to be driven into the keeper when the chair is moved into TV position and to be driven out of the keeper when the chair is returned to the normal or upright position. An intermediate portion of the locking member is pivotally suspended from a front portion of the rocking frame.

DRAWINGS

The above and other objects wil become apparent from the following more detailed description of the drawings in which:

FIG. 1 is a side, elevational view of a linkage system on one side of a chair constituting a preferred embodiment of the present invention when in the normal or upright position;

FIG. 1A is a view similar to FIG. 1 of a lower section of the chair showing in more detail a locking mechanism utilized to prevent rocking movement of the chair when in TV position;

DETAILED DESCRIPTION

Figure 2:
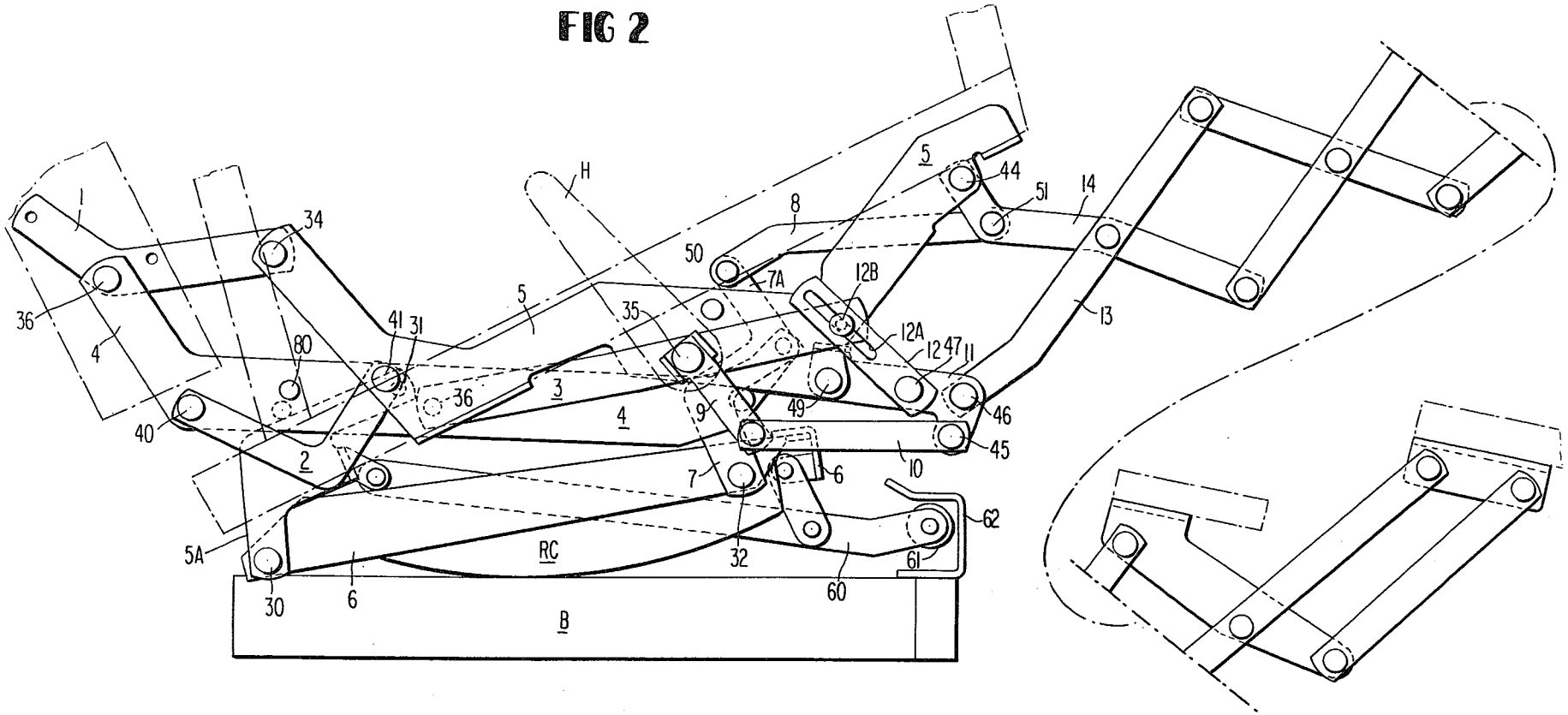
FIG. 2 is a view generally similar to FIG. 1 except that the chair is in the TV position, that is, with the footrest extended.

Referring now to the drawings in detail, there is shown for illustrative purposes only a preferred embodiment of the rocker-recliner chair of the present invention. Basic parts of the chair include: a base B which may be formed in any suitable or conventional manner to rest on the floor; a rocker frame including rocker cams RC (one shown) which may be conventional and a bar or plate 6 fixed to the rocker cam RC to be movable therewith; a seat and armrest unit including a seat S and armrests AR rigidly fixed to the seat S so as to be movable together as a single unit at all times in one mode where the seat and armrest unit rocks together with the rocking frame relative to the base or in other modes where the seat and armrest unit are movable relative to the rocking frame and the base into various reclining positions after the footrest has been moved to extended position known in the trade as "TV" position; a backrest BR which, during the rocking mode of the chair, moves together with the seat and the rocking frame as a unit relative to the base and in another mode moves relative to the seat and the rocking frame into various reclining positions; a footrest linkage FRL including dual footrests FR1 and FR2 movable between a retracted position below the seat as shown, for example, in FIG. 1 and an extended position projected forwardly from the seat as shown, for example, in FIG. 2; and a manual control handle H mounted to one side of the chair for operating the footrest between extended and retracted positions.

The normal or upright position of the chair is illustrated in FIG. 1. In this position, the chair occupant is free to rock the seat and backrest as a unit together with the rocker cams RC on base B. As will be described below, the linkage system prevents relative movement between the backrest and the seat and the rocker frame as long as the footrest is in the retracted position. However, once the footrest is moved into the extended position known as the TV position, a sequencing mechanism, to be described, permits the backrest to be moved relative to the seat and the seat relative to the base to place the chair into various recline positions merely by the occupant exerting pressure on the backrest.

Figure 3:
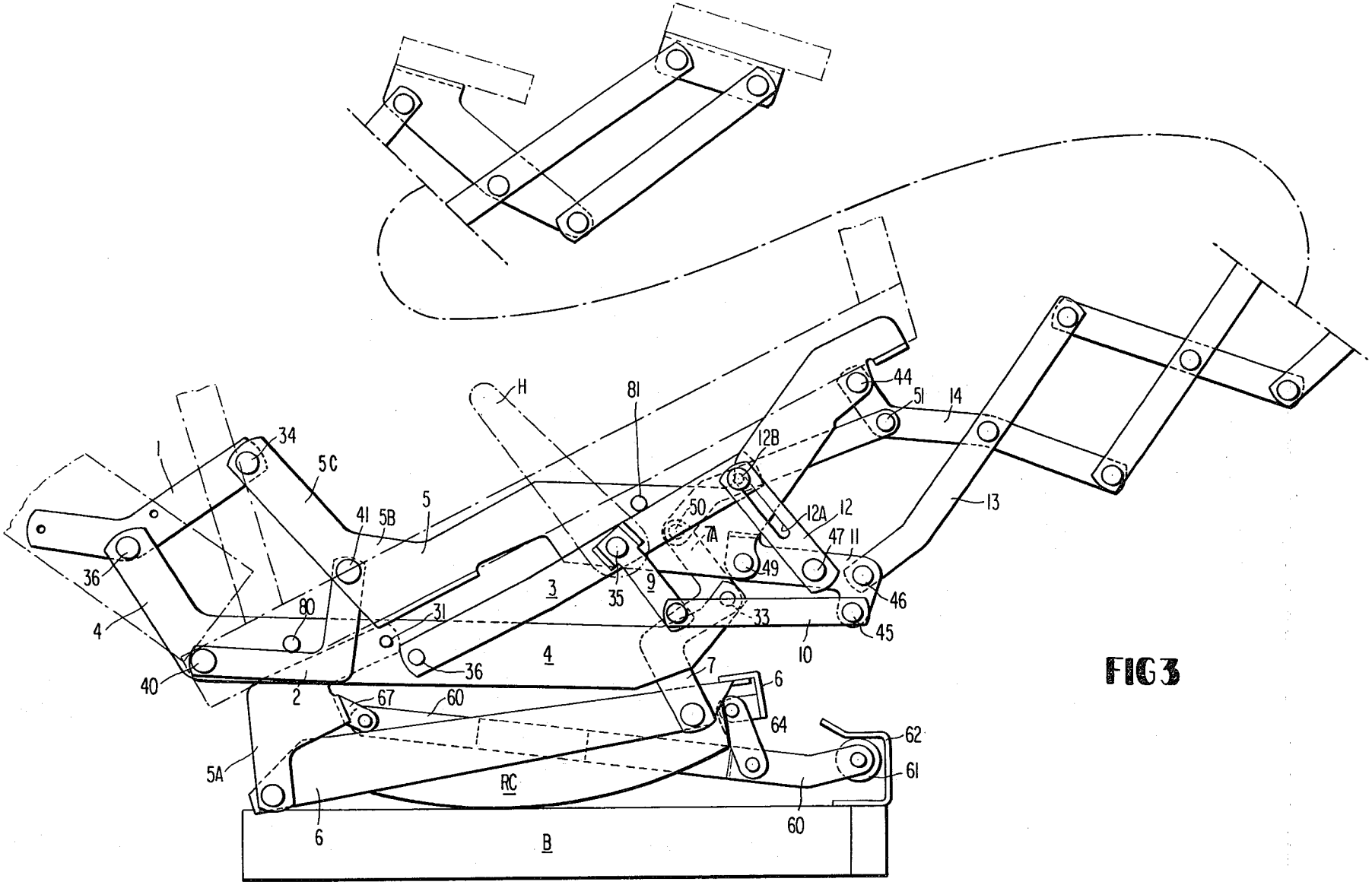
FIG. 3 is a view generally similar to FIG. 2 except that the chair is shown in a fully advanced reclining position.

FIG. 2 illustrates the chair when in the TV position, while FIG. 3 illustrates the chair when in the fully advanced reclining position. When the chair has been moved into TV position, a lock mechanism automatically engages to prevent rocking movement of the rocking frame relative to the base. This will be described in greater detail below.

The various parts of the linkage system will now be described, and although the drawings disclose the linkage system existing on one side of the chair, it should be understood that the linkage system on the other side of the chair will be a mirror image of that disclosed. The linkage system disclosed, which constitutes a preferred embodiment of the invention, includes a carrier link 4 which is elongated and extends in the forward-rearward direction of the chair and has its opposite end portions projecting upwardly at an angle. Carrier link 4 is pivotally mounted to plate 6 of the rocker frame by front and rear carrier mounting links 7 and 5A respectively. Front carrier mounting link 7 has a generally Z-shape in the preferred embodiment and is pivoted to the rocker frame by pivot pin 32 and to the carrier link 4 by pivot pin 33 (see FIG. 3). Rear carrier mounting link 5A has an inverted L-shape and is pivoted to the rear end of the rocker frame by pivot pin 30 and to the carrier link 4 by pivot pin 31.

The seat and armrest unit are pivotally mounted with respect to carrier link 4 by means of a first link 3 pivoted at its lower end to an intermediate portion of carrier link 4 by pivot pin 36. An intermediate portion of link 3 is pivoted by pivot pin 35 to an intermediate portion of a seat link 5; pivot pin 35 also being employed to pivotally mount a footrest actuating link 9 to the link 3 as will be described below. Seat link 5 is elongated with an intermediately positioned V-shaped portion and is rigidly fixed to the side of seat S. The rear end portion of seat link 5 is pivotally mounted relative to carrier link 4 by means of a backrest link 1 which is rigidly fixed to the backrest BR and is pivotally connected by pivot pin 34 to the seat link 5. In turn, backrest link 1 is pivotally mounted by pivot pin 36 to the upwardly projecting rear end portion of carrier link 4.

In order to properly contour the seat while providing the desired amount of leverage for placing the chair in advanced reclining positions as will become apparent below, the rear end portion of seat link 5 is formed with a generally V-shape including an upwardly projecting portion 5C and a bight or bend portion 5B interconnecting upwardly projecting portion 5C and the main body portion of seat link 5. When the chair is placed into advanced reclining positions, the V-shaped portion 5C, 5B of the seat link is stressed in opposite directions on the one hand by the chair occupant's pressure on the backrest BR transmitted through backrest link 1 and on the other hand, by the pressure of the occupant's weight on the seat transmitted to the main body portion of seat link 5. This stress when repeated has a normal tendency to weaken or fatigue the seat link at its bight portion 5B. Hence, in accordance with one of the features of the present invention, a support link 2 shown as having a generally reversed L-shape is pivotally interconnected by pins 40 and 41 between carrier link 4 and seat link 5 generally at the bight portion 5B thereof. Support link 2 will resist and counter the effect of the opposing stresses applied to the seat link 5 at its bight portion 5B when the chair is in advanced reclining positions. However, it should be noted that support link 2 will have no effect in inhibiting relative movement between the seat link 5 and the carrier link 4 when the chair is moved into advanced reclining positions with the exception that the fully advanced or full reclining position of the chair shown in FIG. 3 is limited by a stop 80 fixed to carrier link 4 and engageable with the upper edge of support link 2 as shown in FIG. 3. In addition, the fully advanced reclining position is limited by another stop 81 fixed to seat link 5 to be engageable with the upper edge of link 3 as shown in FIG. 3.

The footrest linkage FRL is basically a lazy-tong type including a mounting link 14 which is pivotally mounted to the front end portion of seat link 5 by means of pivot 44. In addition, the footrest linkage includes a link 13 which is pivotally connected to another footrest mounting link 11 by pivot 46 and, in turn, the footrest mounting link 11 is pivotally mounted by pivot pin 49 to the intermediate V-shaped portion of seat link 5 as best shown in FIGS. 2 and 3. As noted above, a manual control handle H is used for actuating the footrest linkage between the retracted position as shown in FIG. 1 where the footrests FR1 and FR2 extend generally in vertical position one behind the other and the extended position shown in FIG. 3 where the footrests FR1 and FR2 are in generally horizontal position one behind the other. Manual control handle H is rigidly fixed to link 9 which is pivoted by pin 38 to link 3 and seat link 5. Thus, handle H together with link 9, are rotatable about pivot 35 clockwise or counterclockwise depending on whether it is desired to retract or extend the footrest. Handle H and its associated link 9 are connected to footrest mounting link 11 for actuating the footrest between extended and retracted positions by means of a transmission link 10 pivoted at pin 45 to the footrest mounting link 11 and pivoted by pin 44 to link 9. It will be seen that rotation of the handle H about pivot 35 in the counterclockwise direction starting with the position of the chair shown in FIG. 1 will cause the transmission link 10 to pivot the footrest mounting link 11 also in the counterclockwise direction about pivot 49 to extend the footrest linkage FRL to the position shown in FIG. 2. As will be described immediately below, motion of the footrest linkage will be transmitted to the front carrier mounting link 7A to pivot it clockwise about its pivot 32 to the rocker frame causing the carrier link 4 to move forwardly of the base carrying with it the rear carrier mounting link 5A until a stop 90 fixed to the inside of carrier link 4 engages an upper edge portion of the rear carrier mounting link 5A as shown in FIG. 2. This will determine the extended or TV position of the footrest.

In order to achieve advancement of carrier link 4 relative to and forwardly of base B when the chair is moved to the TV position, a transmission link 8 is pivotally connected at one end by pivot 51 to footrest mounting link 14 and is pivotally connected by pivot pin 50 at its rear end to an upper portion 7A of front carrier mounting link 7. With this connection, extension of the footrest linkage will cause transmission link 8 to pivot the front carrier mounting link 7A in the clockwise direction for moving the carrier link forwardly of the chair as described above. Retraction of the footrest linkage will of course have the opposite effect on transmission link 8 and carrier link 4.

The normal or upright position of the chair as shown in FIG. 1 is the position in which the chair occupant may freely rock the seat and backrest as a unit about base B. During this mode, it is desired for comfort purposes that the backrest BR be restrained from moving relative to the seat and that both be restrained from moving relative to the carrier link 4 and rocking frame 6. For this purpose, a sequencing linkage is provided including a sequencing link 12 pivotally mounted by pivot pin 47 to footrest linkage mounting link 11 intermediate the ends of the latter. Sequencing link 12 is provided with an elongated slot 12A for slidably receiving a stop pin 12B fixed to the forward portion of link 3 which mounts seat link 5 to carrier link 4. When the chair is in the normal or upright position shown in FIG. 1, stop pin 12B will be engaged in the upper end of slot 12A and the sequencing link 12 will prevent movement of link 3 and, in turn, relative movement between seat link 5 and carrier link 4. This will also of course prevent movement of the backrest relative to the seat. Thus, when the chair is in the normal or upright position shown in FIG. 1, if the occupant were to exert any pressure on the backrest BR, it would serve to rock the chair but it would not serve to move the backrest or seat relative to the carrier link or rocker frame.

However, when the footrest is moved from retracted position shown in FIG. 1 towards the extended position shown in FIG. 2, footrest mounting link 11 will cause sequencing link 12 to pivot counterclockwise (as viewed in the drawings) to reorient slot 12A having the effect of spacing stop pin 12B from the upper end of slot 12A. This spacing in the preferred embodiment occurs during movement of the footrest from retracted to extended position, such as at the point where the occupant's feet leave the floor. When this occurs, seat link 5 will be freed from its rigid association with backrest link 1 and carrier link 4 so that if the occupant desires to place the chair into a reclining position, he merely leans against the backrest which will cause the latter to fulcrum about pivot 36 rearwardly of the chair which will also have the effect of moving seat link 5 relative to carrier link 4 as illustrated in FIG. 3. When the chair is placed into advanced reclining positions such as for example, the fully reclined position shown in FIG. 3, the stress is imparted to the rear portion 5C, 5B of the seat link on the one hand by the occupant's pressure on the backrest and on the other hand, by the occupant's pressure on the seat will be countered and resisted by support link 2 as mentioned above. This will prevent fatigue of seat link 5 at the bight portion 5B as described above. Also as described above, the fully advanced or reclined position of the chair will be limited and determined by stops 80 and 81 engageable respectively with support link 2 and mounting link 3. If the occupant wishes to return to TV position, he merely has to lean forward in the chair removing pressure from the backrest which will have the effect of returning the linkage parts to the position shown in FIG. 2. If the occupant then wishes to restore the chair to the upright position shown in FIG. 1, he merely pivots the handle H in the clockwise direction.

Figure 2A:
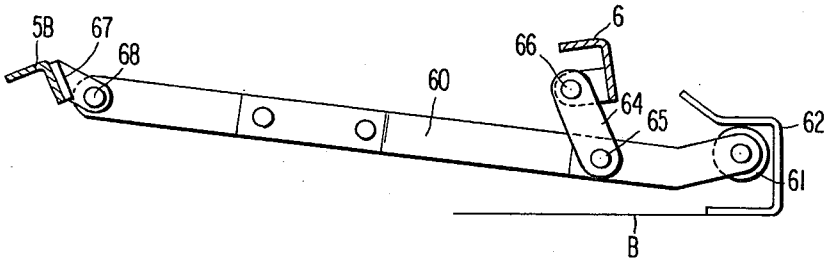
FIG. 2A is a view generally similar to FIG. 1A except that the lock mechanism is shown in engaged position, such as when the chair is in the TV position.

When the chair is moved from the upright or normal position towards the TV position, it is of course desirable that the rocking movement of the chair be prevented to prevent forward lunging of the chair in view of the extension of the footrest. This is a common feature of rocker-recliner chairs. In the preferred embodiment this is achieved by a positive lock mechanism, including a keeper generally designated 62 fixed to the front end of base B for receiving an elongated locking member 60. The latter extends below the seat in the forward-rearward direction and is pivotally connected by pivot 68 to rear carrier mounting link 5A by means of a lug 67 connected to rear carrier mounting link 5A by a crosspiece 5B as best shown in FIGS. 1A and 2A. Keeper 62 forms a U-shaped passage for receiving a roller 61 mounted on the front end of locking member 60 when the chair is moved a certain distance towards the TV position from the normal or upright position. Locking member 60 is mounted at a point intermediate its ends to the rocker frame 6 by means of a mounting link 64 pivoted at 65 to the locking member 60 and at pivot 66 to rocking frame 6 as best shown in FIGS. 1A and 2A.

When the chair is in the normal or upright position for the rocking mode, it will be noted from FIGS. 1 and 1A that locking member 61 will be removed from its keeper 62 thereby permitting rocking of the backrest and seat relative to the base. However, when the chair is moved from the normal or upright position of FIG. 1 towards the TV position of FIG. 2, the forward pivoting movement of the rear carrier mounting link 5A will drive the locking member 60 forwardly to place its roller 61 within keeper 62 to thus prevent rocking movement of the chair. When the chair is returned to the normal or upright position, the opposite movement of rear carrier mounting link 5A will withdraw locking member 60 from its keeper to thus free the chair for rocking movement. Although not clear from the drawings, it should be understood that keeper 62 is mounted along the longitudinal center of the base B below the longitudinal center of the seat and that locking member 60 is similarly positioned. Also lug 67 is fixed to rear carrier mounting link 5A by a crosspiece 96 which interconnects the rear carrier mounting links. Similarly, and although not shown, the linkage system on the side of the chair opposite that shown in the drawings is operated by a torque tube which interconnects handle link 9 with the linkage system on the opposite side of the chair.

Finally it should be understood that although the appended claims contain numerals for facilitating understanding of the claimed subject matter, the numerals in the claims should not be construed as restricting the claimed subject matter to the specific preferred embodiment shown in the drawings.

What is claimed is:

1. A three-way rocker-recliner chair having a base, a rocker frame (6) mounted on the base for rocking movement in the forward-rearward direction of the chair, a carrier link (4), front and rear carrier mounting links (7, 5A) mounting the carrier link to the rocker frame for movement generally forwardly and rearwardly of the rocker frame, a seat including a seat link (5), armrests fixed to the seat for movement with the seat as a unitary structure, a seat mounting link (3) pivotally interconnected and mounting the seat link to the carrier link, a backrest including a backrest link (1) pivotally mounted to the carrier link and pivotally connected to the seat link for movement relative thereto, said backrest link (1) and seat mounting link (3) serving to mount the seat link relative to the carrier link, a seat support link (2) pivotally connected to the seat link and the carrier link to provide support for the seat link when the chair is in advanced reclining positions wherein the backrest has moved relative to the seat, a footrest including a footrest linkage mounting the footrest to the seat for movement between extended and retracted positions, a manual control handle connected to the footrest linkage to actuate the same between extended and retracted positions, a transmission link (8) interconnecting the footrest linkage and one of the carrier mounting links (5A, 7) for driving the carrier link forwardly relative to the rocker frame when the footrest is moved to extended positions, and sequencing linkage (12, 12A, 12B) preventing relative movement between the backrest link (1) and seat link (5) and the carrier link (4) during an initial phase of movement of the footrest from retracted to extended position and subsequently allowing such relative movement to phace the chair in advanced reclining positions when pressure is exerted on the backrest by the occupant of the chair, and wherein the seat link (5) has a generally V-shape including a bight portion and extends upwardly at its rear end and wherein said seat support link (2) is connected to said seat link in the area of said bight portion, and wherein when moving to advance reclining positions the backrest link (1) fulcrums about a rear end portion of the carrier link.

2. The chair defined in claim 1 wherein there is further included a locking member extending below the seat in the forward-rearward direction of the chair, a keeper fixed to the base at a front portion thereof and adopted to receive the locking member to prevent rocking movement of the rocker frame, the locking member having a rear end portion pivotally connected to the rear carrier link (5A) to be actuated thereby in the forward direction of the chair and into the keeper when the footrest is moved to extended position to thereby prevent rocking of the chair, said locking member being removable from the keeper by said rear carrier mounting link (5A) to permit rocking movement of the chair when the footrest is moved to retracted position causing the carrier link to move in the rearward direction of the chair.

3. The chair defined in claim 2 wherein said locking member intermediate its ends is pivotally mounted to said rocker frame.

4. The chair defined in claim 1 wherein said sequencing linkage includes a sequencing link (12) having one end portion pivotally mounted on the footrest linkage and having an elongated slot in an opposite end portion thereof, said seat mounting link (3) has an extension extending beyond its connection to the seat and having a stop pin received in said slot of the sequencing link.

5. The chair defined in claim 1 wherein said sequencing linkage includes a sequencing link (12) having one end portion pivotally mounted on the footrest linkage and having an elongated slot in an opposite end portion thereof, said seat mounting link (3) has an extension extending beyond its connection to the seat and having a stop pin received in said slot of the sequencing link.

6. The chair defined in claim 5 wherein there is further included a locking member extending below the seat in the forward-rearward direction of the chair, a keeper fixed to the base at a front portion thereof and adopted to receive the locking member to prevent rocking movement of the rocker frame, the locking member having a rear end portion pivotally connected to the rear carrier link (5A) to be actuated thereby in the forward direction of the chair and into the keeper when the footrest is moved to extended position to thereby prevent rocking of the chair, said locking member being removable from the keeper by said rear carrier mounting link (5A) to permit rocking movement of the chair when the footrest is moved to retracted position causing the carrier link to move in the rearward direction of the chair.

7. The chair defined in claim 6 wherein there is further included a locking member extending below the seat in the forward-rearward direction of the chair, a keeper fixed to the base at a front portion thereof and adopted to receive the locking member to prevent rocking movement of the rocker frame, the locking member having a rear end portion pivotally connected to the rear carrier link (5A) to be actuated thereby in the forward direction of the chair and into the keeper when the footrest is moved to extended position to thereby prevent rocking of the chair, said locking member being removable from the keeper by said rear carrier mounting link (5A) to permit rocking movement of the chair when the footrest is moved to retracted position causing the carrier link to move in the rearward direction of the chair.

8. The chair defined in claim 7 wherein said locking member intermediate its end is pivotally mounted to said rocker frame.

* * * * *